US011073266B2

(12) United States Patent
Zhou

(10) Patent No.: US 11,073,266 B2
(45) Date of Patent: Jul. 27, 2021

(54) LIGHTING ASSEMBLY

(71) Applicant: Richpower Industries, Inc., Williamston, SC (US)

(72) Inventor: Lifeng Zhou, Williamston, SC (US)

(73) Assignee: RICHPOWER INDUSTRIES, INC., Williamston, SC (US)

( * ) Notice: Subject to any disclaimer, the term of this patent is extended or adjusted under 35 U.S.C. 154(b) by 0 days.

(21) Appl. No.: 15/737,343

(22) PCT Filed: Jul. 29, 2016

(86) PCT No.: PCT/US2016/044654
§ 371 (c)(1),
(2) Date: Dec. 18, 2017

(87) PCT Pub. No.: WO2017/023730
PCT Pub. Date: Feb. 9, 2017

(65) Prior Publication Data

US 2018/0163957 A1 Jun. 14, 2018

Related U.S. Application Data

(60) Provisional application No. 62/199,322, filed on Jul. 31, 2015.

(51) Int. Cl.
*F21V 21/30* (2006.01)
*F21V 21/06* (2006.01)
(Continued)

(52) U.S. Cl.
CPC ..... *F21V 21/30* (2013.01); *F21V 21/06* (2013.01); *F21V 21/22* (2013.01); *F21S 6/005* (2013.01);
(Continued)

(58) Field of Classification Search
CPC ..... F21V 21/30; F21V 21/06; F21V 21/22; F21V 21/0824; F21Y 2115/10; F21W 2131/1005; F21S 9/02; F21S 6/005
See application file for complete search history.

(56) References Cited

U.S. PATENT DOCUMENTS 7,311,423 B2 12/2007 Frecska et al.
8,201,979 B2 * 6/2012 Deighton ..... F16M 11/28 248/177.1
(Continued)

FOREIGN PATENT DOCUMENTS

CN 1483959 A 3/2004
CN 104501066 A 4/2015
(Continued)

OTHER PUBLICATIONS

Co-Pending International Application No. PCT/US16/44654, International Search Report and Written Opinion, dated Dec. 28, 2016, 10 pages.
(Continued)

*Primary Examiner* — Evan P Dzierzynski
(74) *Attorney, Agent, or Firm* — Thrive IP; Bernard S. Klosowski

(57) ABSTRACT

Systems and methods are provided for lighting systems that are compact and portable, and adaptable to various lighting requirements simultaneously when opened and used in an intended use environment.

6 Claims, 16 Drawing Sheets

(51) Int. Cl.

| | |
|---|---|
| ***F21V 21/22*** | (2006.01) |
| *F21V 21/08* | (2006.01) |
| *F21Y 115/10* | (2016.01) |
| *F21W 131/10* | (2006.01) |
| *F21S 9/02* | (2006.01) |
| *F21S 6/00* | (2006.01) |
| *F21W 131/402* | (2006.01) |

(52) U.S. Cl.

CPC ..... *F21S 9/02* (2013.01); *F21V 21/0824* (2013.01); *F21W 2131/1005* (2013.01); *F21W 2131/402* (2013.01); *F21Y 2115/10* (2016.08)

(56) References Cited

U.S. PATENT DOCUMENTS

| | | | | |
|---|---|---|---|---|
| 8,651,438 | B2 | 2/2014 | Deighton et al. | |
| 9,091,401 | B2 | 7/2015 | Wong et al. | |
| 9,810,408 | B2 * | 11/2017 | Fang | F21V 21/06 |
| 2005/0083692 | A1 * | 4/2005 | Leen | F21S 8/08 362/223 |
| 2012/0261530 | A1 | 10/2012 | Deighton et al. | |
| 2013/0094196 | A1 | 4/2013 | Wessel | |
| 2013/0128565 | A1 | 5/2013 | Cugini et al. | |
| 2013/0265780 | A1 | 10/2013 | Choksi et al. | |
| 2014/0283891 | A1 | 9/2014 | Lovley, II et al. | |
| 2014/0301066 | A1 | 10/2014 | Inskeep | |
| 2015/0225123 | A1 | 8/2015 | Zetterlund | |
| 2016/0033119 | A1 | 2/2016 | Mumma | |

FOREIGN PATENT DOCUMENTS

| | | | |
|---|---|---|---|
| EP | 2890924 | A1 | 7/2015 |
| JP | 4110775 | B2 | 4/2008 |
| WO | 0244503 | A1 | 6/2002 |

OTHER PUBLICATIONS

Co-Pending European Application No. 16833594.1, Extended European Search Report, dated Nov. 14, 2018, 15 pages.

Abstract of CN 104501066 retrieved from Espacenet, 1 page.

Abstract of CN 1483959 retrieved from Espacenet, 1 page.

* cited by examiner

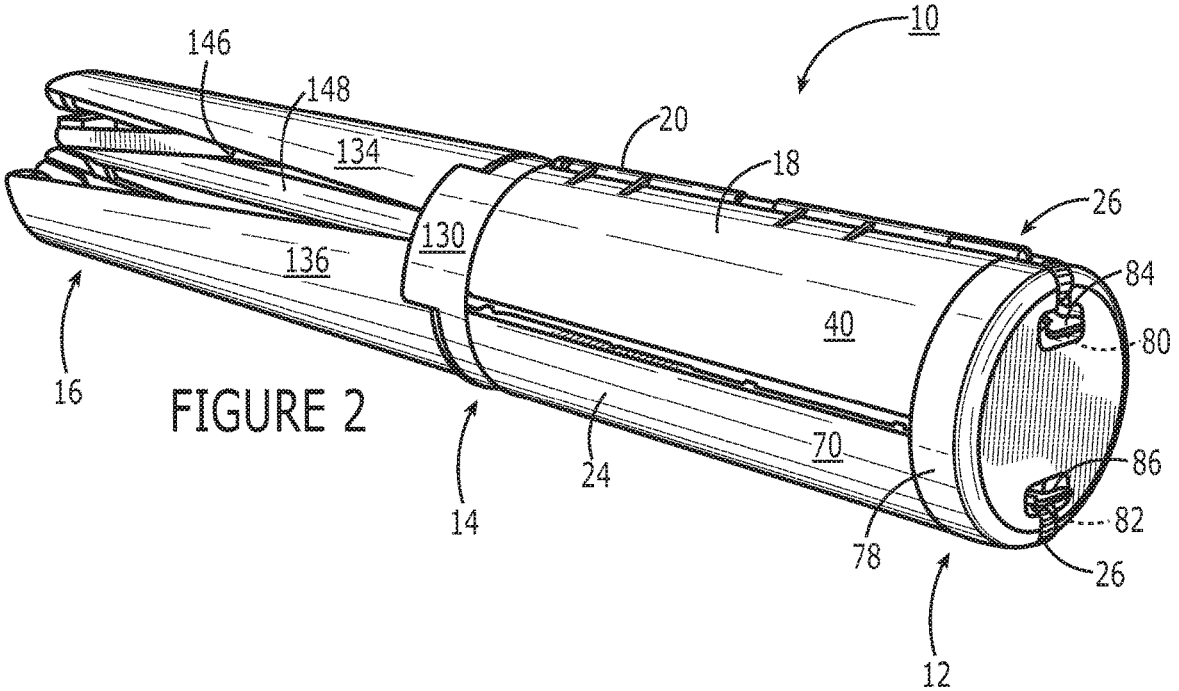
FIGURE 2
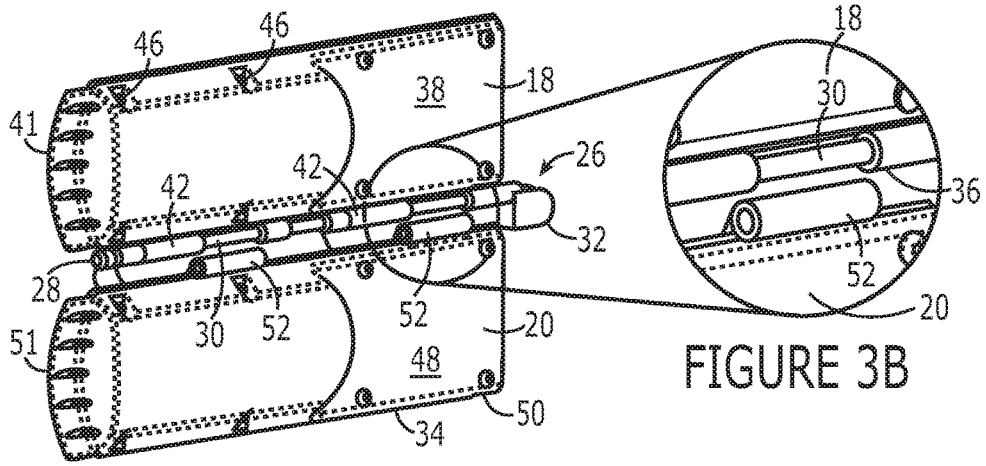
FIGURE 3B
FIGURE 3A
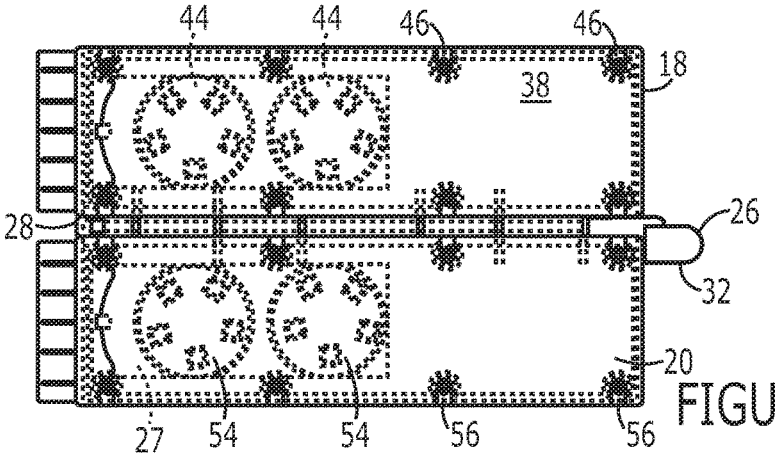
FIGURE 3C

LIGHTING ASSEMBLY

CROSS-REFERENCE TO RELATED APPLICATIONS

This utility patent application claims benefit of U.S. Provisional Patent Application Ser. No. 62/199,322, filed in the United States Patent and Trademark Office on Jul. 31, 2015, which is incorporated herein by reference in its entirety.

BACKGROUND OF THE DISCLOSURE

Known transportable lighting systems are bulky and heavy, are not easily adjustable, and have limited functions.

What is lacking and needed in the industry is a portable lighting system that can be easily transported and positioned. Furthermore, the desired system should be adjustable to accommodate various working environments and applications.

BRIEF SUMMARY OF THE DISCLOSURE

The present disclosure is directed in general to a compact, portable lighting system that can be expanded quickly to provide multiple, adjustable light fixtures to accommodate different working environments and applications. The lighting system may have multiple light panels. Each light panel may be adjusted separately on multiple axes, and together, the panels may form a single, omni-directional light source. The lighting system is collapsible and modular for portability by a single person.

In one aspect of the disclosure, a lighting apparatus is configured to collapse into a tubular shape and may have a plurality of adjustable light panels.

In another aspect, a lighting system may be tubular in shape and have at least four light panels. Each light panel may have a plurality of lights, and the light panels may be adjustable in multiple axes.

In another aspect, a lighting system may include a light head having a plurality of light panels with the panels being adjustable relative to each other; a body having at least two rods, the rods being configured to telescope relative to each other; a base having a plurality of feet; and a quick release mechanism for adjusting the body. Each light panel may be configured to adjust in at least three axes. The quick release mechanism may include a ring and a handle with the handle being configured to apply pressure to the ring to render the rods stationary.

The lighting system may further include a collar configured to move about one of the rods and to adjust the feet. The body may include a stand having a space defined therein, and further include a stake disposed in the space, the stake being configured to extend from the body to stabilize the system. Additionally, or alternatively, a plurality of stakes, such a U-shaped, may be provided to secure the feet to ground.

In another aspect, a method of employing a lighting system may include providing a lighting assembly having a plurality of light panels and a stand assembly, the panels being adjustable relative to each other; opening the lighting assembly to expose the light panels; extending the stand assembly; and adjusting the panels to illuminate a workpiece.

The method may include having light panels that are adjustable along multiple axes, and may further include anchoring the lighting assembly with one or more stakes or spikes disposed in the lighting assembly. The method may further include a power supply carried in the lighting assembly. The power supply may selectively power the light panels.

Additional objects and advantages of the present subject matter are set forth in, or will be apparent to, those of ordinary skill in the art from the description herein. Also, it should be further appreciated that modifications and variations to the specifically illustrated, referenced, and discussed features, processes, and elements hereof may be practiced in various embodiments and uses of the disclosure without departing from the spirit and scope of the subject matter. Variations may include, but are not limited to, substitution of equivalent means, features, or steps for those illustrated, referenced, or discussed, and the functional, operational, or positional reversal of various parts, features, steps, or the like. Those of ordinary skill in the art will better appreciate the features and aspects of the various embodiments, and others, upon review of the remainder of the specification.

BRIEF DESCRIPTION OF THE DRAWINGS

A full and enabling disclosure of the present subject matter directed to one of ordinary skill in the art is set forth in the specification, which makes reference to the appended figures, in which:

FIG. 2 is a perspective view of the lighting system as in FIG. 1, particularly showing the system in a second condition;

FIGS. 3A, 3B, and 3C are partial, perspective, exploded, and plan views of a light fixture of the lighting system as in FIG. 1;

DETAILED DESCRIPTION OF THE DISCLOSURE

Figure 1:
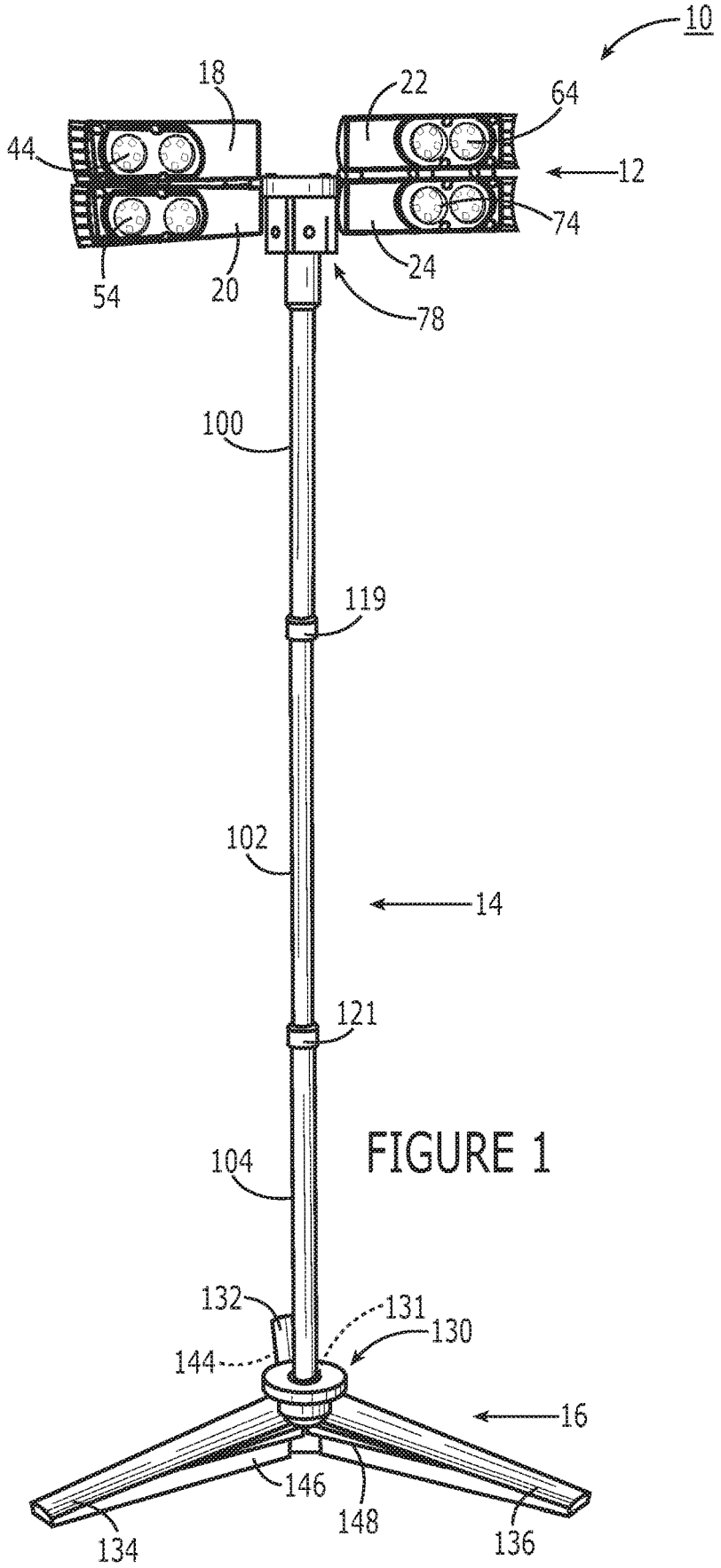
FIG. 1 is a front elevational view of a lighting system according to an aspect of the present disclosure, particularly showing the system in a first condition.

In general, the present disclosure provides systems and methods for improved operations and functionality of lighting systems. The systems are economical to make and use.

Detailed reference will now be made to the drawings in which examples embodying the present subject matter are shown. The detailed description uses numerical and letter designations to refer to features of the drawings. The drawings and detailed description provide a full and written description of the present subject matter, and of the manner and process of making and using various exemplary embodiments, so as to enable one skilled in the pertinent art to make and use them, as well as the best mode of carrying out the exemplary embodiments. However, the examples set forth in the drawings and detailed descriptions are provided by way of explanation only and are not meant as limitations of the disclosure. The present subject matter thus includes any modifications and variations of the following examples as come within the scope of the appended claims and their equivalents.

Although detailed embodiments are disclosed as required, it is to be understood that the embodiments are merely exemplary. The figures are not necessarily to scale, and some features may be exaggerated to show details of particular components. Therefore, specific structural and functional details disclosed herein are not to be interpreted as limiting, but merely as a basis for the claims and as a representative basis for teaching one skilled in the art to variously employ the various embodiments of the present disclosure.

Unless defined otherwise, all technical and scientific terms used herein have the same meaning as is commonly understood by one of ordinary skill in the art to which this disclosure belongs. In the event that there is a plurality of definitions for a term herein, those in this section prevail unless stated otherwise.

Wherever the phrase "for example," "such as," "including" and the like are used herein, the phrase "and without limitation" is understood to follow unless explicitly stated otherwise. Similarly "an example," "exemplary" and the like are understood to be non-limiting.

The term "substantially" allows for deviations from the descriptor that do not negatively impact the intended purpose. Descriptive terms are understood to be modified by the term "substantially" even if the word "substantially" is not explicitly recited.

The term "about" when used in connection with a numerical value refers to the actual given value, and to the approximation to such given value that would reasonably be inferred by one of ordinary skill in the art, including approximations due to the experimental and or measurement conditions for such given value.

The terms "comprising" and "including" and "having" and "involving" (and similarly "comprises", "includes," "has," and "involves") and the like are used interchangeably and have the same meaning. Specifically, each of the terms is defined consistent with the common United States patent law definition of "comprising" and is therefore interpreted to be an open term meaning "at least the following," and is also interpreted not to exclude additional features, limitations, aspects, etcetera. Thus, for example, "a device having components a, b, and c" means that the device includes at least components a, b and c. Similarly, the phrase: "a method involving steps a, b, and c" means that the method includes at least steps a, b, and c.

Unless the context clearly requires otherwise, throughout the description and the claims, the words "comprise", "comprising", and the like are to be construed in an inclusive sense as opposed to an exclusive or exhaustive sense; that is to say, in the sense of "including, but not limited to".

Any discussion of prior art in the specification should in no way be considered as an admission that such prior art is widely known or forms part of common general knowledge in the field.

The various embodiments of the disclosure and/or equivalents falling within the scope of present disclosure overcome or ameliorate at least one of the disadvantages of the prior art, or provide a useful alternative.

Turning now to the figures, FIG. 1 shows a lighting system, designated in general by the numeral 10, in a first condition or state such as an open or extended position. The exemplary lighting system 10 broadly includes a top, top apparatus, or head 12, a middle portion or body 14, and a base or stand 16. As shown, the head 12 will have a light arm, panel or wing 18 and may have additional, multiple panels such as panels 20, 22, 24. The panels 18, 20, 22, 24 each may have one or more lights or light emitting diodes (LEDs) designated, respectively, 44, 54, 64, 74, and the panels 18, 20, 22, 24 may be operably connected or attached to the body 14 at a top or end cap assembly 78. The body 14 may include multiple extension components, rods, or bars 100, 102, 104. Here, a slidable collar or ring 130 is disposed about the rod 104 and a release lock mechanism 120 is located between the rod 102 and rod 104. Similarly, a release lock mechanism 119 is located between rods 100 and 102. By way of brief introduction, as shown in this example, the head 12 may be unfolded, unpacked or extended from the body 14 using the release lock mechanisms 119, 121 and the slidable collar 130, the operations of which will be described in greater detail below.

The base 16 shown in FIG. 1 may include multiple feet, legs or extensions such as legs 132, 134, and 136. Although three legs 132, 134, and 136 are shown in this example, the number of legs can vary. Here, the legs 132, 134, and 136 are curved or tapered and operably connected or attached to the collar 130. Each leg has a respective rod or bar 144, 146, 148, which bend, slide or articulate to extend or contract with movements or adjustments of the collar 130. More particularly, the collar 130 includes a hole or aperture 131, which is sized to slide up and down the rod 104. As the collar 130 moves downward or in a direction away from the head 12, the legs 132, 134, 136 extend outward as shown in FIG. 1. In this fully extended state, the exemplary lighting system 10 may stand approximately 72 inches to about 80 inches in height, particularly about 76 inches.

FIG. 2 shows the lighting system 10 in a second condition or state such as a compact or folded position. In this closed state, an exterior or outer shell or surface 40 of the first light panel 18 and an exterior or outer surface 70 of the fourth light panel 24 are shown next to each other substantially between the head 12 and the body 14. (See FIG. 5A for interior and exterior surfaces of each light panel). The exterior surface 40 and other exterior shells may be made of durable, water-resistant, scratch-resistant material such as moldable thermoplastic, including but not limited to an acrylic-polyvinyl chloride composite or polyethylene (high (HDPE) or low density (LDPE)). Channels, gaps or recesses 80, 82 in the end portion 78 shelter or protect release mechanisms or tabs 84, 86. The recesses 80, 82 also hold or encompass portions of the arms 26. In operation, the tabs 84, 86 may be activated to release the light panels 18, 20, 22, 24. In this example, the tabs 84, 86 will be pulled in a direction of the arms 26 and the light panels 18, 20, 22, 24 can be opened away from the body 14. The tabs 84, 86 will then recover to their respective recesses 80, 82 to maintain a low profile appearance.

Also shown in FIG. 2, due to their exemplary curved surfaces or curvatures, the outer surfaces 40, 70 may be folded or closed in line with, or under a periphery of, the end portion 78. Seen from this perspective, a first light fixture arm 26 extends between the end cap 78 and the collar 130. As will be discussed below, the light panel 18 shares the light fixture arm 26 with adjoining panel 20.

FIG. 2 also shows extending from the collar 130 in a direction of the base 16, the outer surface leg 134 and its underlying structural rod 146, which are next to the leg 136 and its rod 148. In this compact second state, the exemplary lighting system 10 may be approximately 25 inches to about 30 inches in length, particularly about 28.4 inches, and it may be about 3 inches to about 10 inches in diameter, particularly about 5 inches.

With reference to FIG. 3A-C, the light panels 18, 20, by way of example, are shown most clearly from multiple viewpoints. Here, the interior or light sides 38, 48 of their respective light panels 18, 20 may each include respective projections, cover extensions, or eaves 37, 51 that, when the lighting system 10 is in a closed state as in FIG. 2, will abut the collar 130 to present a unitary appearance. As shown, the interior face 38, if not molded to or snapped in, may be accessed or removed from the light panel 18 by way of screws or other attachment devices 46 to facilitate removal, replacement or repair of lights 44. Similarly, lights 54 on the interior side 48 of the light panel 20 may accessed by attachment devices 56. In this example, the lights 44, 54 may be recessed or depressed into their respective surfaces 38, 48 for compactness and to protect the lights 44, 54. Also, as particularly shown in FIG. 3C, each light component 44, 54 may be covered with clear plastic such as Plexiglas® brand material, glass, or a glare-reducing clear cover material 27, and each light component 44, 54 may include five interspersed LEDs. Fewer, additional, and/or different lighting elements may be utilized and are not limited to this example.

As particularly shown in the exploded and inset views of FIGS. 3A and 3B, the arm 26 includes a distal end or end cap 28, a rod or armature 30, and a proximal armature, joint or end 32. Extending from the panel 18 is at least one tube or nodule 42 having a snap-fit, open cup side, or a channel therethrough, to receive the rod 30. Likewise, extending from the panel 20 is at least one tube or protuberance 52 having a snap-fit connection or a channel therein to receive the rod 30 therethrough. As shown, the rod 30 extends through to the joint 32, and locating teeth 36 on the tubes 42, 52, in cooperation with one or more springs 34 in the arm 26, allow the panels 18, 20 to be rotated to a variety of desired positions relative to each other (compare FIGS. 4, 5A-C). The springs 34 may be made of stainless steel or another durable material capable of providing a spring constant.

Figure 4:
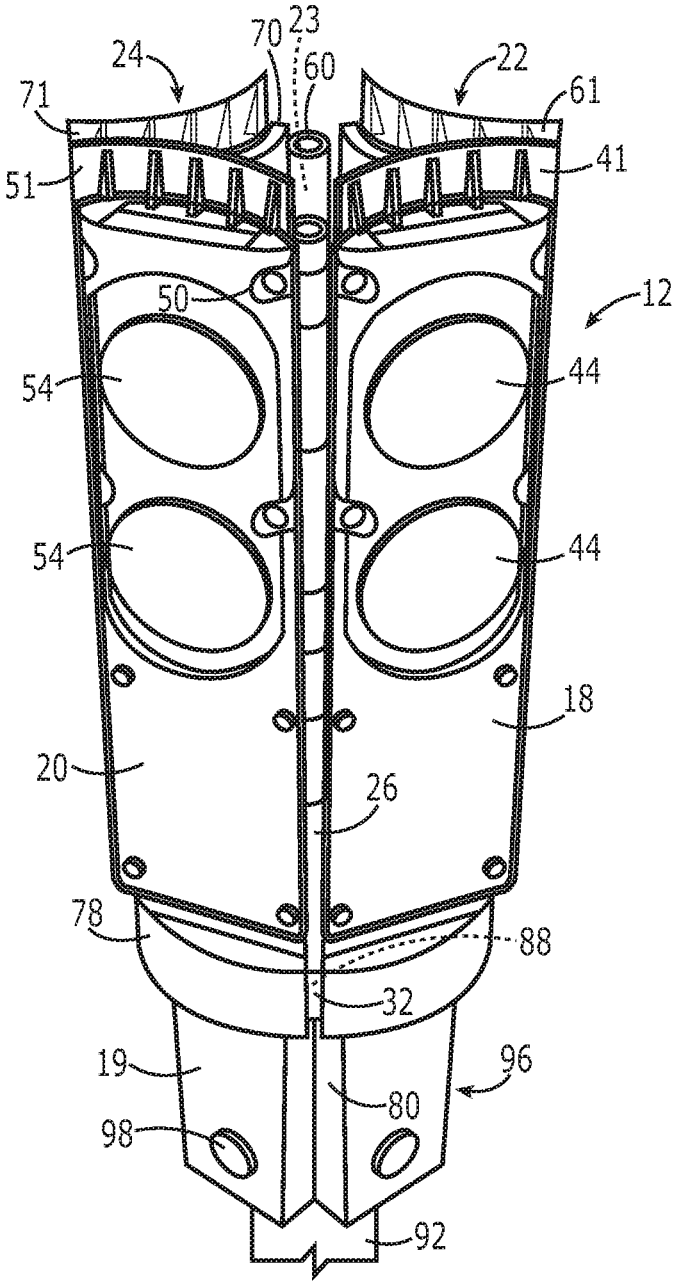
FIG. 4 is a partial, perspective view of multiple light fixtures of the lighting system as in FIGS. 1 and 3A-C, particularly showing the light fixtures in an upright position.

FIG. 4 most clearly shows the head 12 and it light panels 18, 20, 22, 24 in an exemplary upright position for use, for instance, as an omni-directional light source. From this perspective, the lights 44, 54 are shown facing substantially normal or perpendicular relative to a holder or sleeve 92 extending from the end cap assembly 78 configured to receive the rod 100 (see, e.g., FIG. 5A). As shown, the panels 18, 20, 22, 24 are folded about their respective arms 26 in an inward direction such that their exterior surfaces, such as 60, 70, face each other. More particularly, portions of the eaves 41, 51, 61, 71 may be closer to each other to form a diamond shaped void 23 between the panels 18, 20, 22, 24, and lights 44, 54, for instance, face outwardly at an angle to each other for general room illumination, for instance.

FIG. 4 also clearly shows the end cap assembly 78, which includes the sleeve 92 briefly introduced above and the channel 80 for receipt of the arm 26. The armature 32 is also shown rotatable in a shoulder notch or opening 88. Further, a power supply 96 may be part of the assembly 78. The power supply 96 may be battery operated, solar powered, or electrically wired to a power source. A power switch 98 for controlling the power supply 96 to turn the lights 44, 54 on or off may be a push-button, a pressure sensor, and the like. In a folded state, recesses 19 are provided in the assembly 78 to receive the panels 18, 20, 22, 24 so that their respective exterior surfaces are substantially flush with the perimeter of the assembly 78 (see FIG. 2).

Figure 5A:
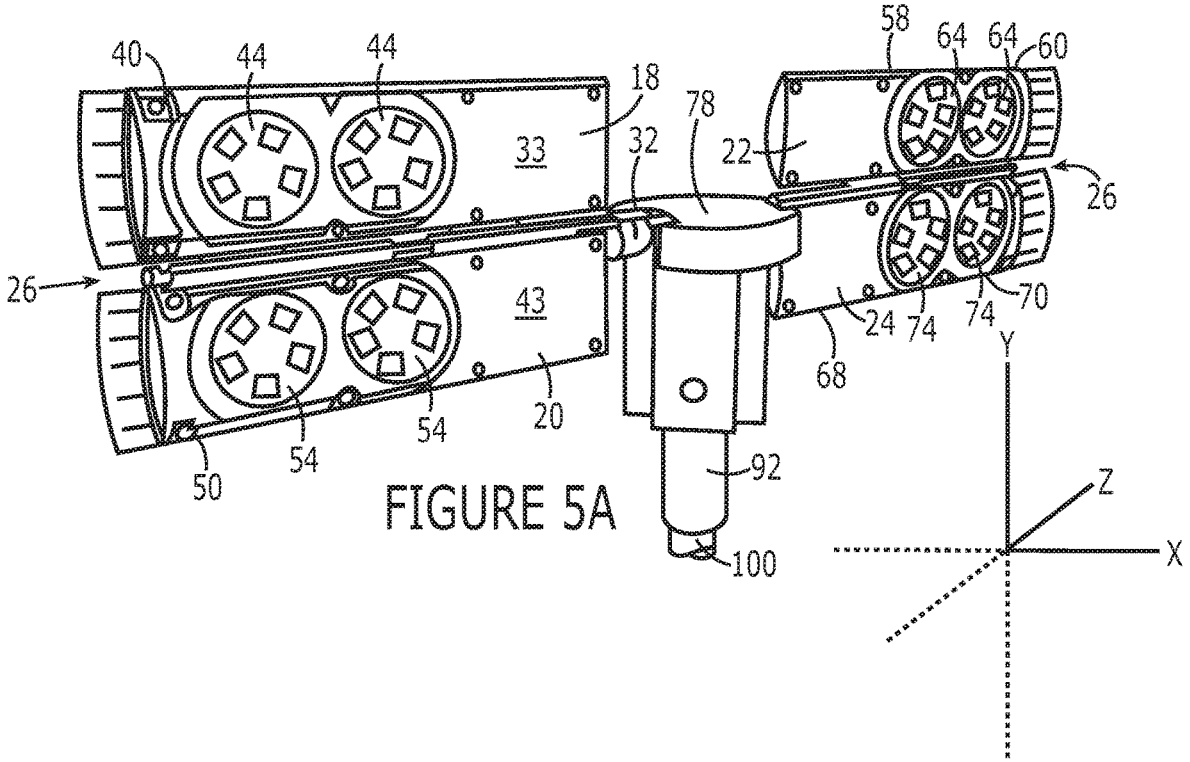
FIGS. 5A, 5B, and 5C are partial, perspective views of the multiple light fixtures as in FIGS. 1, 3A-C and 4, particularly showing the light fixtures in additional positions.
Figure 5B:
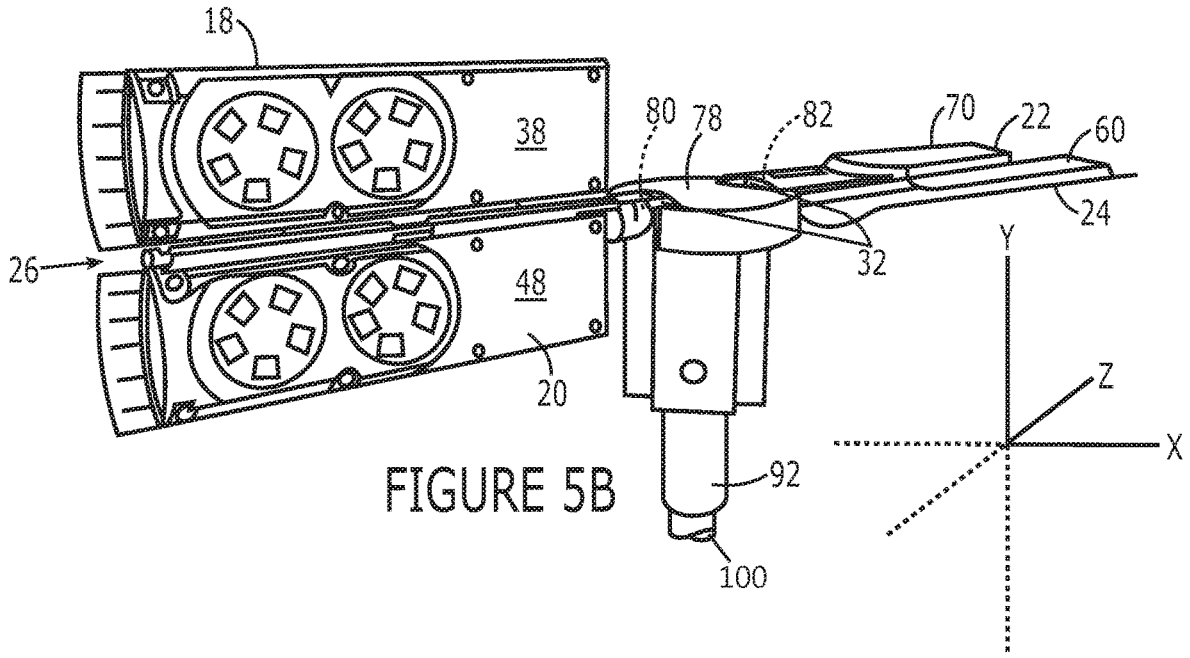
Figure 5C:
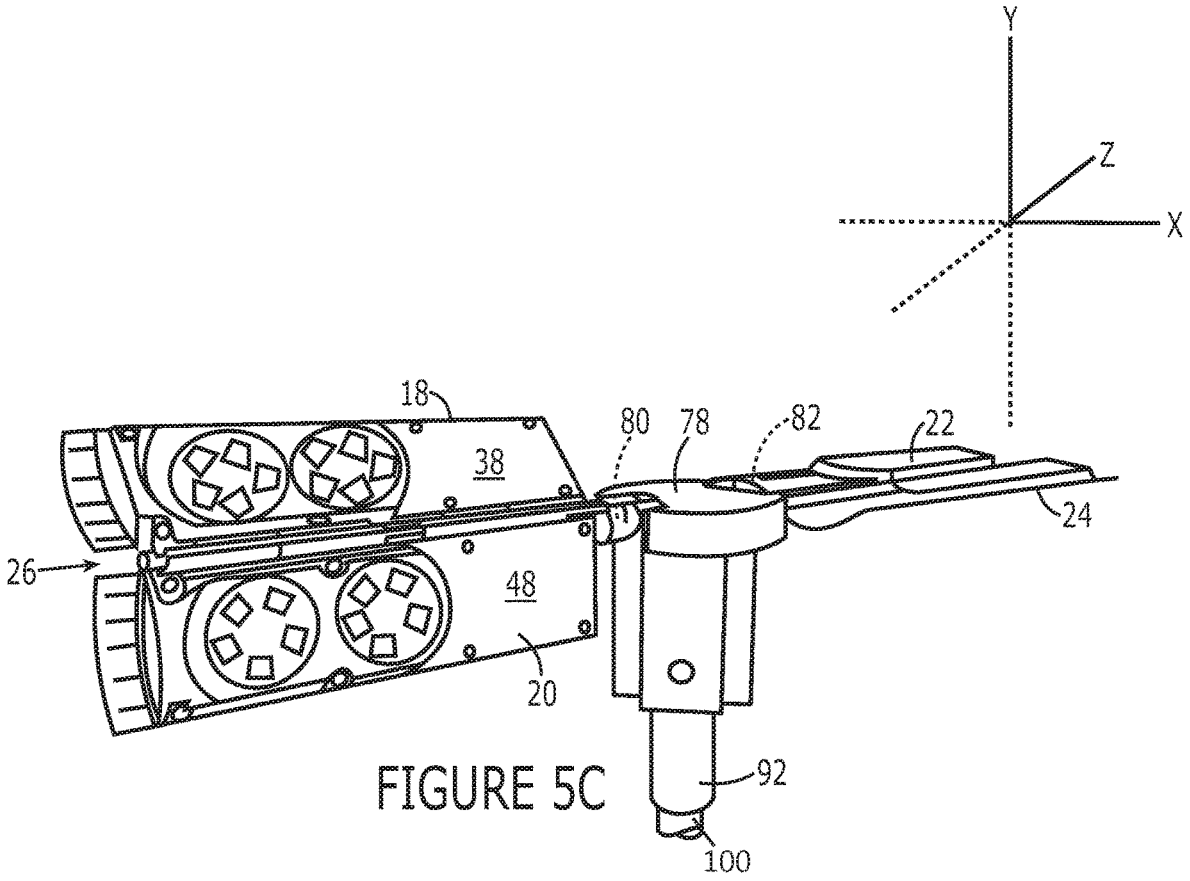

FIGS. 5A, 5B and 5C are exemplary operational views of the head 12 particularly showing the sleeve 92 of the assembly 78 installed with or mated to the rod 100. As shown in FIG. 5A, the light panels 18, 20, 22, 24 may be oriented along various axes X-Y-Z and are here positioned substantially in a vertical plane along the Y-axis; in other words, the lights 44, 54, 64, 74 are all facing in the same direction, e.g., outward along the Y-axis. This arrangement may be desirable to light a wall for instance while painting. In FIG. 5B, the light panels 22, 24 are rotated about their arm 26 along the Z-axis in this orientation. Additionally, or alternatively, the armature 32 may rotate in the socket 82 to achieve this arrangement, which may be useful, for instance, when separate projects in front of and below the system 10 require illumination. Finally, FIG. 5C shows yet another arrangement of the light panels 18, 20, 22, 24 in which panels 22, 24 face downward, panel 20 faces forward, and panel 18 faces at an angle upward to accommodate disparate lighting requirements. From the foregoing examples, those skilled in the art will understand that each light panel 18, 20, 22, 24 may be adjusted up and down or rotated to certain positions along or offset from various axes X-Y-Z by employing light fixture arms 26 and articulating joints 32 in order to have front-facing, downward facing, upward-facing arrangements and/or to exhibit different angles or be positioned to form a lamp as in FIG. 4. Thus, the exemplary apparatus 12 and its panels 18, 20, 22, 24 are similar in some ways to an arm and its hand and fingers, which are connected to a shoulder and adjustable to multiple positions through a rotator cuff.

Figure 6:
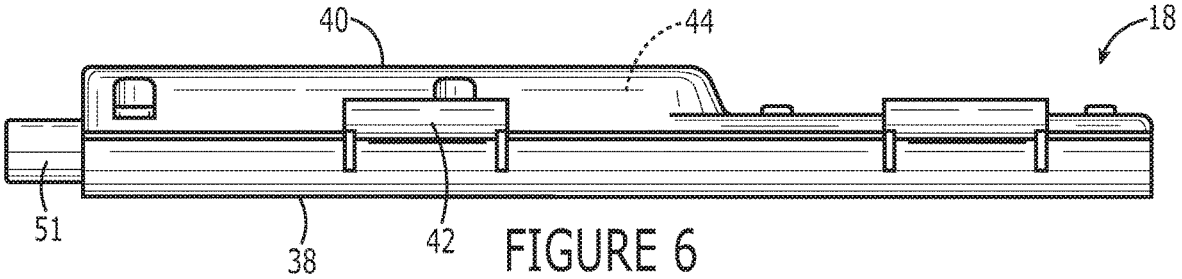
FIG. 6 is a side, elevational view of one of the light fixtures as in FIGS. 1 and 3A-C.

Turning to FIG. 6, the exemplary light panels introduced above, represented here by panel 18, may be approximately 8 inches to about 12 inches in length, particularly about 10.7 inches (including extension 51); about 2.5 inches to about 5 inches in width, particularly about 3.1 inches (excluding tubes 42); and about 1 inch to about 1.5 inches in thickness, particularly about 1.2 inches. Although the panel 18 is substantially rectilinear and rectangular in shape in this example, panel sizes may vary depending on the types and sizes of the lights 44, as noted above.

Figure 7:
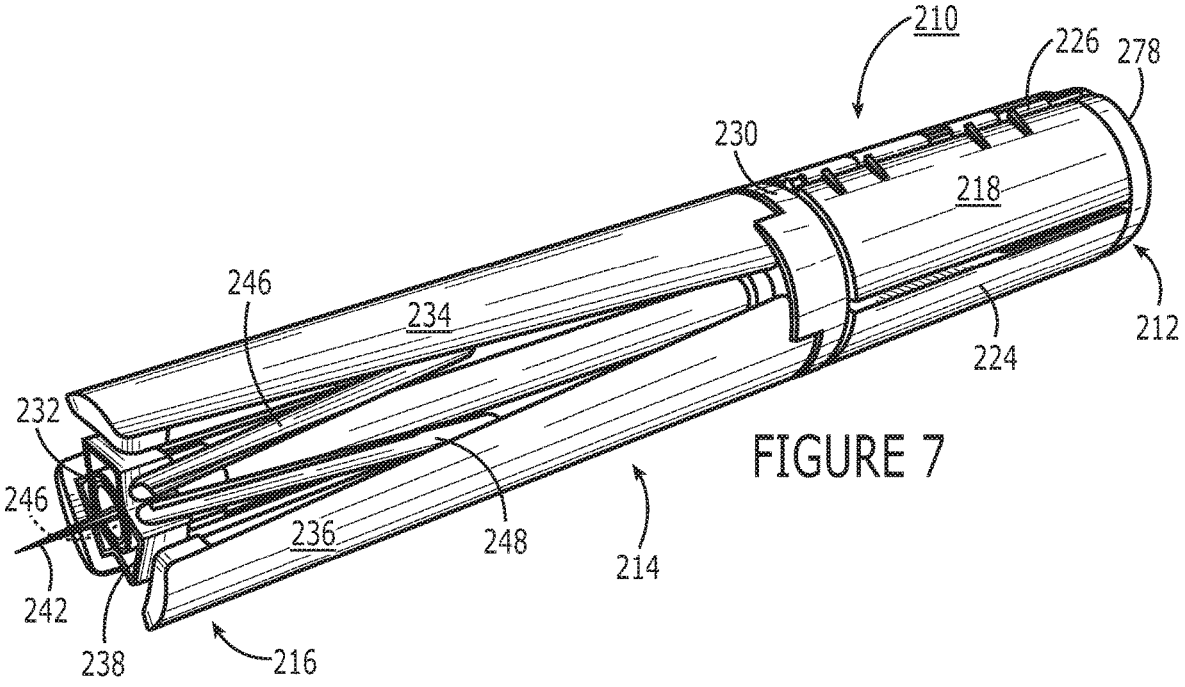
FIG. 7 is a perspective view of a lighting assembly according to another aspect of the disclosure, particularly showing the system in a mobile condition.

FIG. 7 shows a lighting assembly 210 according to another aspect of the disclosure. Here, the lighting assembly 210 is in a second condition or state such as a compact or folded position. In this state, a light panel 218 and another light panel 224 of a crown or top 212 neighbor each other. Due to their exemplary curvatures, the light panels 218, 224 may be folded flush, or in line with, or under a periphery of, an end portion 278 located near the crown 212. Also seen from this perspective, a light fixture joint 226 extends between the end cap 278 and a girdle or collar 230 approximately midway along a body 214 of the assembly 210. Also shown extending from the collar 230 are the outer surface leg 234 and complementary structural shaft or rod 246 positioned next to leg 236 and its related shaft 248. The third exemplary leg 232 can be partially seen in this perspective. As shown, the three legs 232, 234, 236 form a tripod foot or stand 216, which may include a center base or midpoint 238 having a storage space or orifice 240 for a spike, anchor, or stake 242. The stake 242, shown extended, will assist in stabilizing or securing the stand 216 on a lawn or a soft and/or uneven surface. In its compressed or closed state, the exemplary lighting system 210 may be approximately 25 inches to about 30 inches in length, particularly about 28.4 inches (with stake 242 retracted), and it may be about 3 inches to about 10 inches in diameter, particularly about 5 inches.

Figure 8:
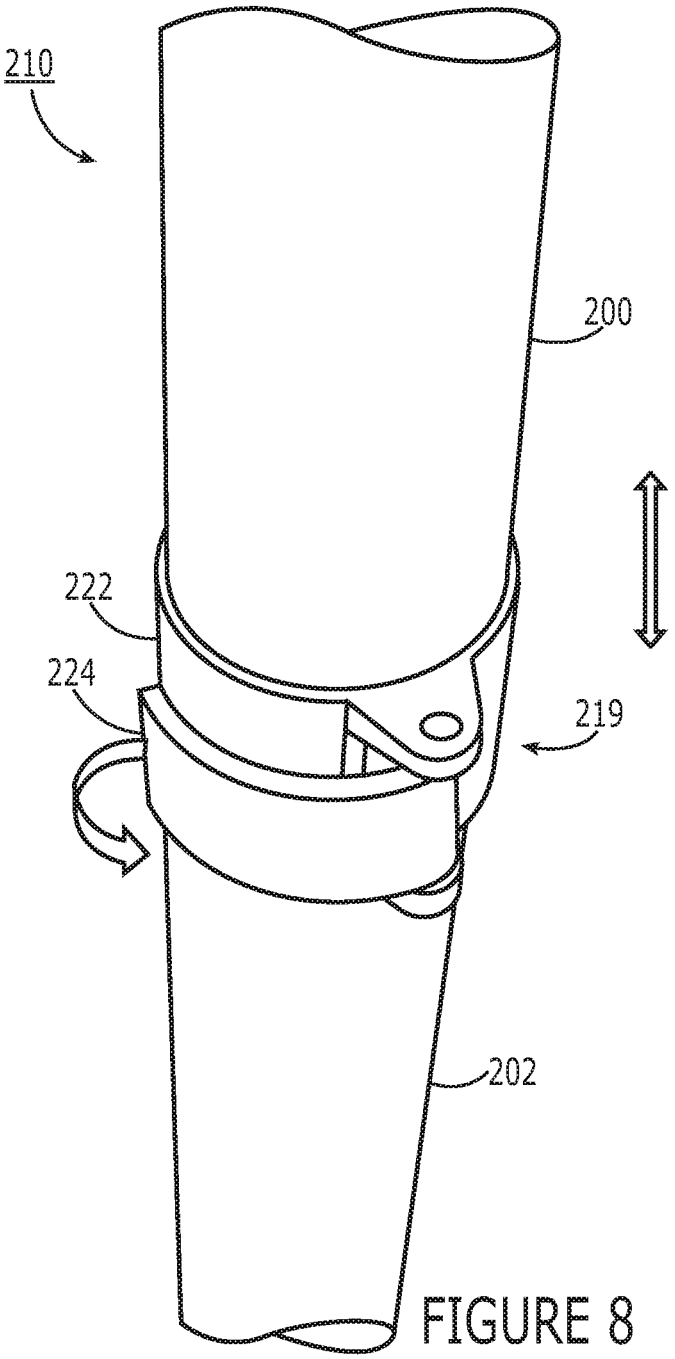
FIG. 8 is a partial, detailed view of an adjustment component according to an aspect of the disclosure.

With reference now to FIG. 8, a portion of the system 210 is shown with a locking and adjustment mechanism 219 positioned between rods 200, 202. Here, the rod 200 may be smaller in circumference than the rod 202 to permit the rod 200 to slide into the rod 202 for storage, or to adjust height. The rod 200 may be extended from within the rod 202 as indicated by the double-headed arrow. Alternatively, the circumferences of the rods 200, 202 may be reversed, such that rod 202 can be stored within rod 200 if desired. Extension or storage of the rods 200, 202 is accomplished in part by the quick release mechanism 219. In this detailed view, the mechanism 219 may be operated by releasing a handle, tab or switch 224 away from a ring or band 222 as indicated by the curved, rotational arrow. Once the rods 200, 202 are positioned relative to each other at a desired height, the band 222 may be squeezed or tightened by pressing the handle 224 toward the band 222 to lock the rods 200, 202 in position.

Figure 9:
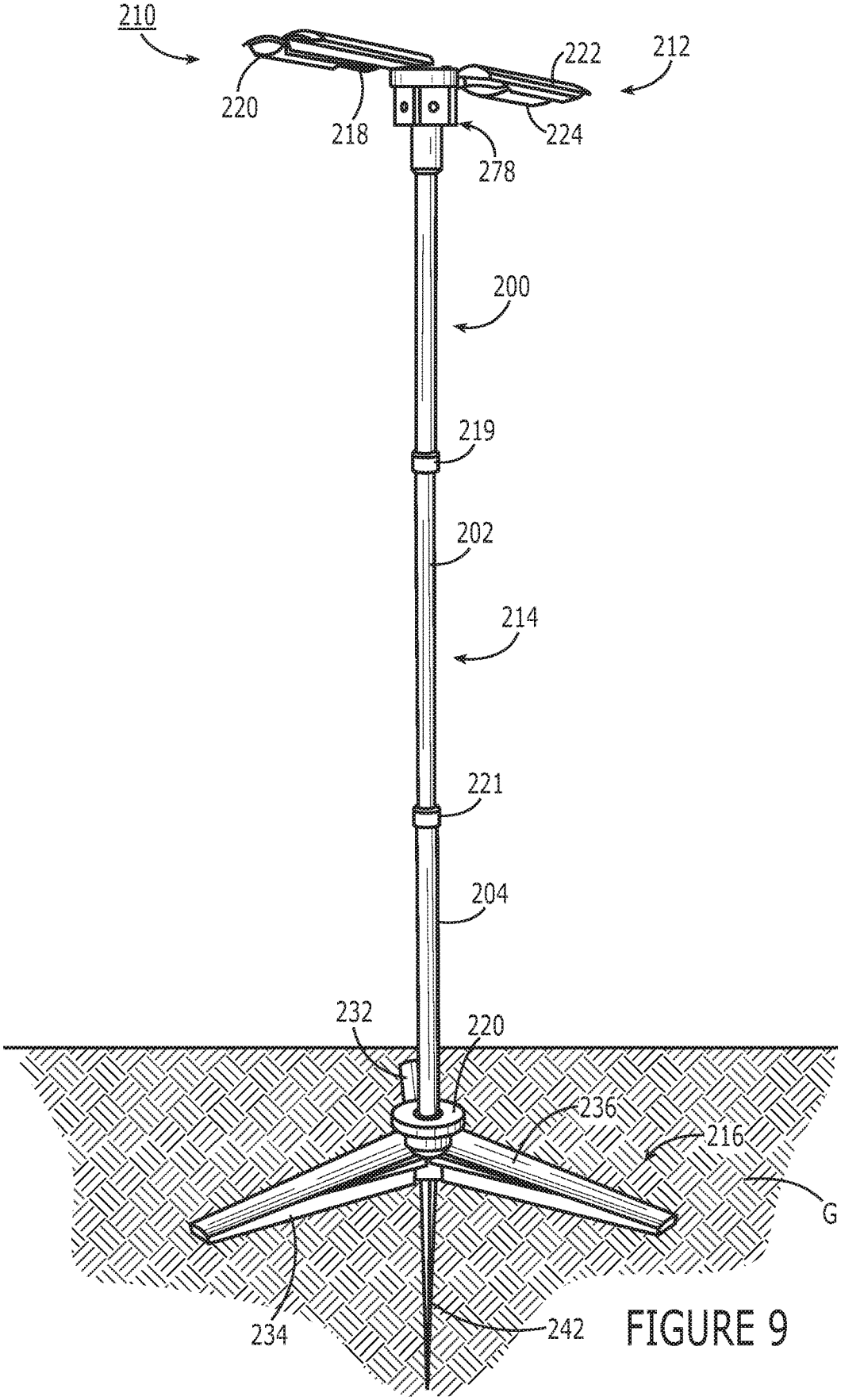
FIG. 9 is a perspective view of the lighting system as in FIG. 8, particularly showing the system in an operational condition.

FIG. 9 most clearly shows the system 210 in which rods 200, 202, 204 are extended to a desired height set by height adjustment assemblies 219, 221. As shown in this example, the lamp panels 218, 220, 222, 224 of the lighting panel assembly 212 face toward the ground, indicated by dashed lines and the letter G. Also in this view, the base 216 is locked in an open position by virtue of the collar 230 being depressed downward to cause the legs 232, 234, 236 to extend outward and substantially horizontal or parallel to the ground G. Also shown, the stake 242 may be extended into the ground G to stabilize the system 210.

Figure 10:
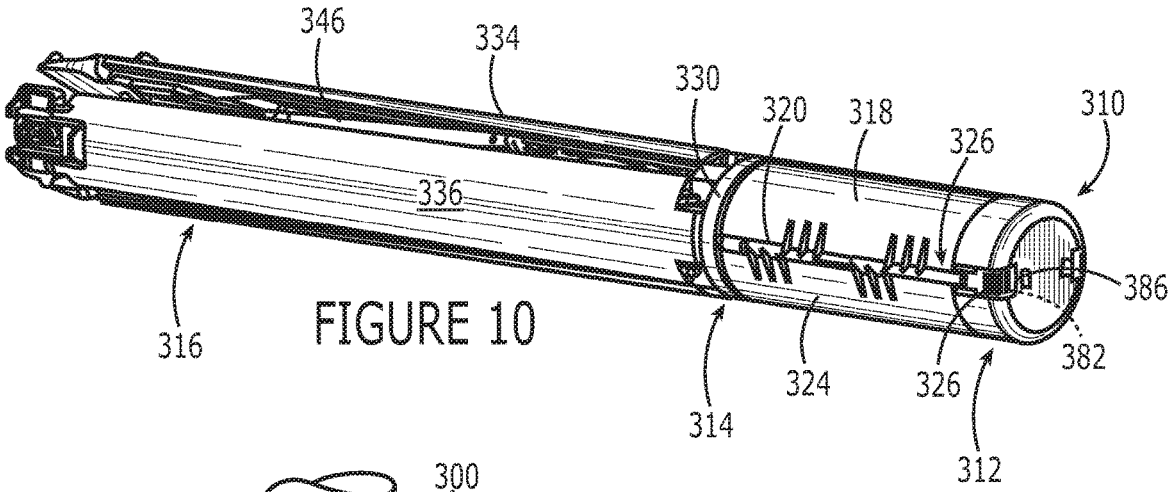
FIG. 10 is a perspective view of a lighting system according to another aspect of the disclosure, particularly showing the system in a portable state.
Figure 11:
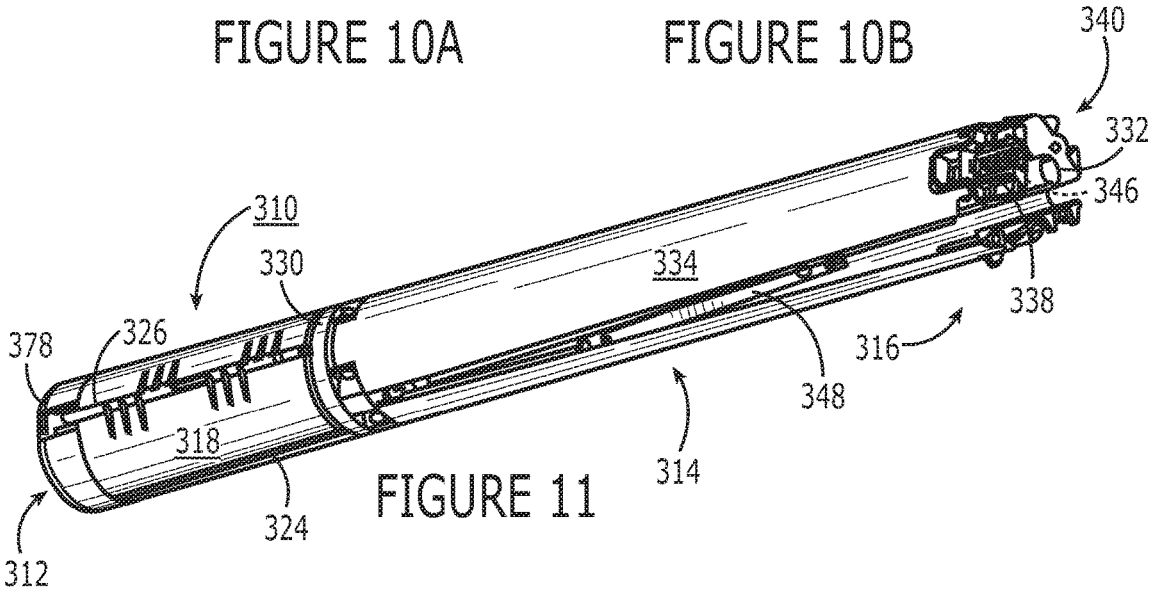
FIG. 11 is another perspective view of the lighting system as in FIG. 10.
Figure 12:
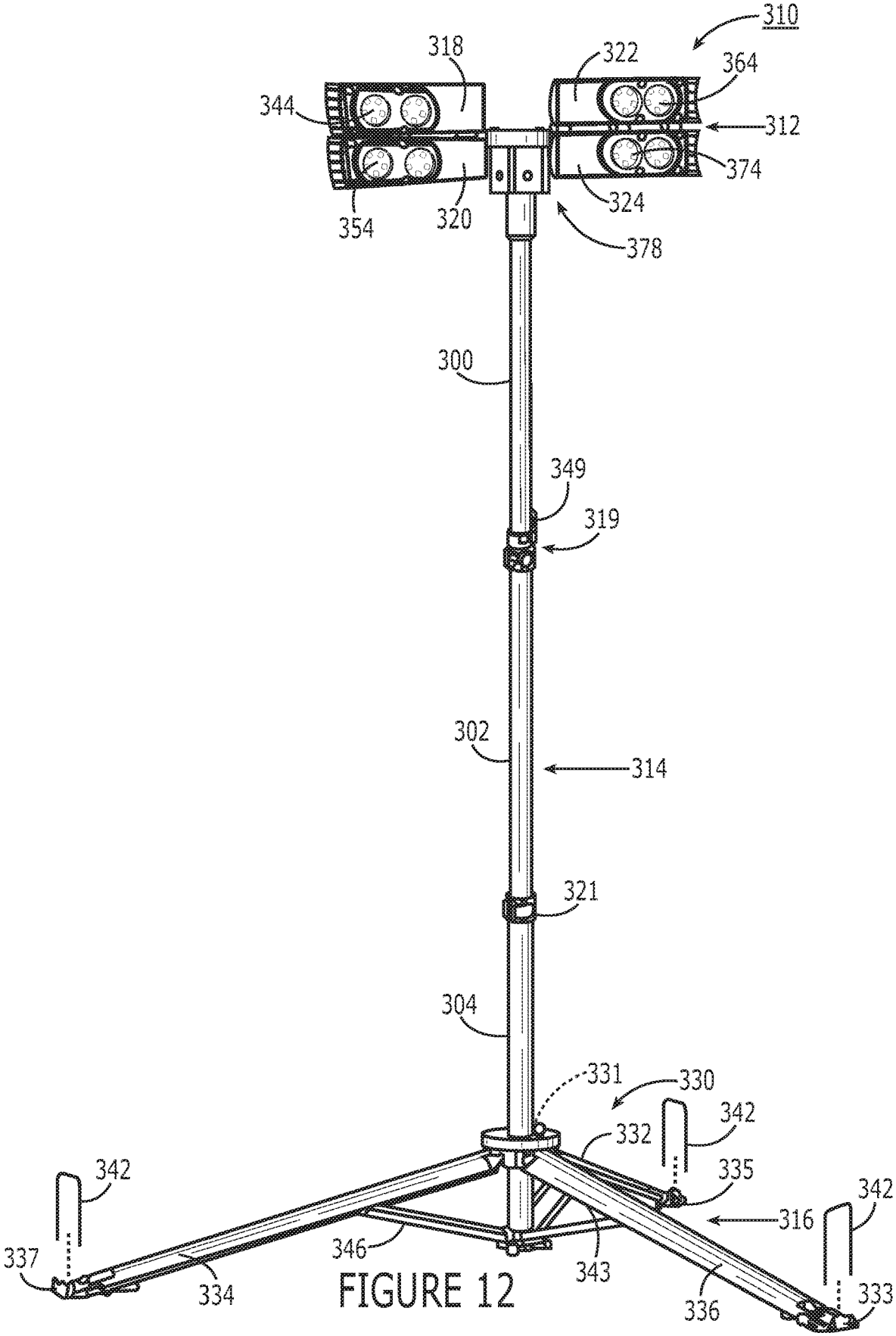
FIG. 12 is a perspective view of the lighting system as in FIG. 10, particularly showing the system in an operational state.

Turning now to FIGS. 10 through 12, a lighting system 310 according to another aspect of the disclosure is shown in a compact, closed, initial, or folded position, which also may be referred to herein as a second condition or state (compare to a first condition or state in FIG. 12). In this compact state, the exemplary lighting system 310 may be approximately 25 inches to about 30 inches in length, particularly about 28.4 inches, and it may be about 3 inches to about 10 inches in diameter, particularly about 5 inches. As shown, the exemplary lighting system 310 broadly includes a top, top apparatus, or head 312, a middle portion or body 314, and a base or stand 316. As shown, the head 312 will have a light arms, panels or wings 318, 320, 322, 324. The panels 318, 320, 322, 324 may be operably connected or attached to the body 314 at a top or end cap assembly 378. In this example, a slidable collar or ring 330 is disposed the middle portion 314, the operation of which will be described in greater detail below.

The base 316 shown in FIGS. 10 and 11 may include multiple feet, legs or extensions such as legs 332, 334, and 336. Although three legs 332, 334, 336 are shown in this example, the number of legs can vary. Also in this example, the legs 332, 334, 336 are curved or tapered and operably connected or attached to the collar 330. Each leg may have a respective internal rod or bar 344, 346, 348, each of which will bend, slide or articulate to extend or contract with movements or adjustments of the collar 330.

In the closed state of FIG. 10, an exterior or outer shell or surface 340 of the first light panel 318 and an exterior or outer surface 370 of the fourth light panel 324 are shown next to each other substantially between the head 312 and the body 314. The exterior surface 340 and other exterior shells may be made of durable, water-resistant, scratch-resistant material such as moldable thermoplastic, including but not limited to an acrylic-polyvinyl chloride composite or polyethylene (high (HDPE) or low density (LDPE)). Channels, gaps or recesses 380, 382 in the end portion 378 shelter or protect release mechanisms or tabs 384, 386. The recesses 380, 382 also hold or encompass portions of the arms 326. In operation, the tabs 384, 386 may be activated to release the light panels 318, 320, 322, 324. In this example, the tabs 384, 386 will be pulled in a direction of the arms 326 and the light panels 318, 320, 322, 324 can be opened away from the body 314. The tabs 384, 386 will then recover to their respective recesses 380, 382 to maintain a low profile appearance.

Also shown in FIG. 10, due to their exemplary curved surfaces or curvatures, the outer surfaces 340, 370 may be folded or closed in line with, or under a periphery of, the end portion 378. Seen from this perspective, a first light fixture arm 326 extends between the end cap 378 and the collar 330. As will be discussed below, the light panel 318 shares the light fixture arm 326 with adjoining panel 320. Also seen from this perspective, a light fixture joint 326 extends between the end cap 378 and the collar 330 approximately midway along the body 314 of the assembly 210. FIG. 10 further shows extending from the collar 330 in a direction of the base 316 the outer surface leg 334 and its underlying structural rod 346, which are next to leg 336 and its rod 348.

Figure 10A:
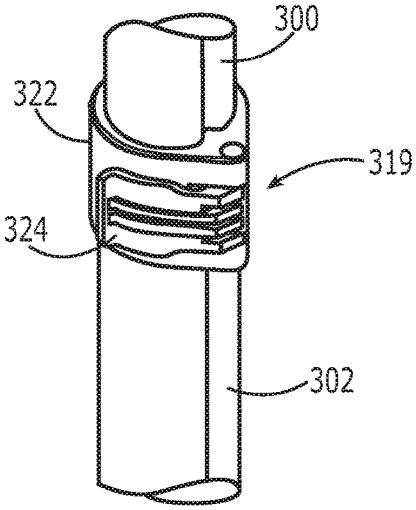
FIG. 10A is a partial, detailed view of an aspect of the embodiment of FIG. 10.

FIG. 10A particularly shows a release and locking mechanism 319 of the system 310. Here, the adjustment mechanism 319 positioned between poles 300, 302. The pole 300 may be smaller in circumference than the pole 302, or vice versa, to permit one pole to slide into the other for storage, or to adjust height. In this detailed view, the mechanism 319 may be operated by releasing a handle, tab or switch 324 away from a ring or band 322. Once the poles 300, 302 are positioned relative to each other at a desired height, the band 322 may be squeezed or tightened by pressing the handle 324 toward the band 322 to lock the poles 300, 302 in position.

Figure 10B:
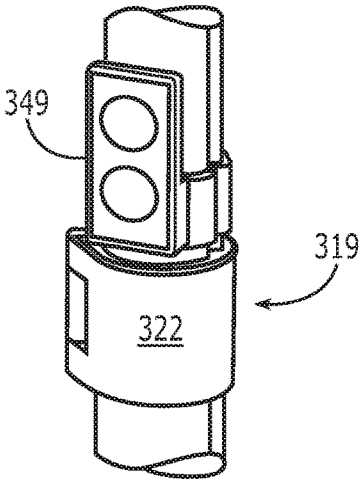
FIG. 10B is a partial, detailed view of another aspect of the embodiment of FIG. 10.

FIG. 10B shows another side of the mechanism 319. Here, the band 322 is most clearly shown, and a remote sensor 349, such as infrared, is located near the band 322. The remote sensor 349 can be used with a remote control unit (not shown) to turn the system 310 on and off or to adjust brightness of its lights.

FIG. 11 particularly shows the light panels 320, 326. As with their counterpart panels 318, 324, their exemplary curvatures allow them to be folded flush, or in line with, or under a periphery of, the end portion 378 located near the crown 312. Also shown extending from the collar 330 are the outer surface leg 334 and complementary structural shaft or rod 346 positioned next to leg 336 and its related shaft 348. The third exemplary leg 332 can be partially seen in this perspective. As shown, the three legs 332, 334, 336 form the tripod foot or stand 316, which may include a center base or midpoint 338 having a storage space or orifice 240 for spikes or stakes 342 described in FIG. 12 below.

FIG. 12 shows the lighting system 310 in the first condition or state as introduced above. In this open or extended position, the panels 318, 320, 322, 324 each may have one or more lights or light emitting diodes (LEDs) designated, respectively, 344, 354, 364, 374, and the panels 318, 320, 322, 324 may be operably connected or attached to the body 314 at the cap assembly 378. The body 314 may include multiple extension components, rods, or bars 300, 302, 304. Here, the slidable collar or ring 330 is disposed about the rod 304 and the release lock mechanism 319 is located between the rod 300 and rod 302. Similarly, the release lock mechanism 321 is located between rods 302 and 304. In this example, the remote sensor 349 is located near the adjustment mechanism 319, but the sensor 349 could be positioned near the mechanism 321 or at another desired position on the assembly 310.

FIG. 12 also shows that as the collar 330 moves downward or in a direction away from the head 312, the legs 332, 334, 336 extend outward. In this fully extended state, the exemplary lighting system 310 may stand approximately 72 inches to about 80 inches in height, particularly about 76 inches.

Also shown in FIG. 12, one or more anchors or stakes 342 (shown in a ready or preliminary position for stabilizing respective legs 332, 334, 336) assist in anchoring or securing the stand 316 on a grass lawn or other soft and/or uneven surface. As shown, each of the three legs 332, 334, 336 have respective extension features or capture gates 333, 335, 337 that flip open or fold outward to buttress, trap, or press against the u-shaped ends of the anchors 342 to keep the anchors 342 and the ends of the legs 332, 334, 336 from sliding apart when the anchors 342 are in position about the capture gates 333, 335, 337.

Figure 13A:
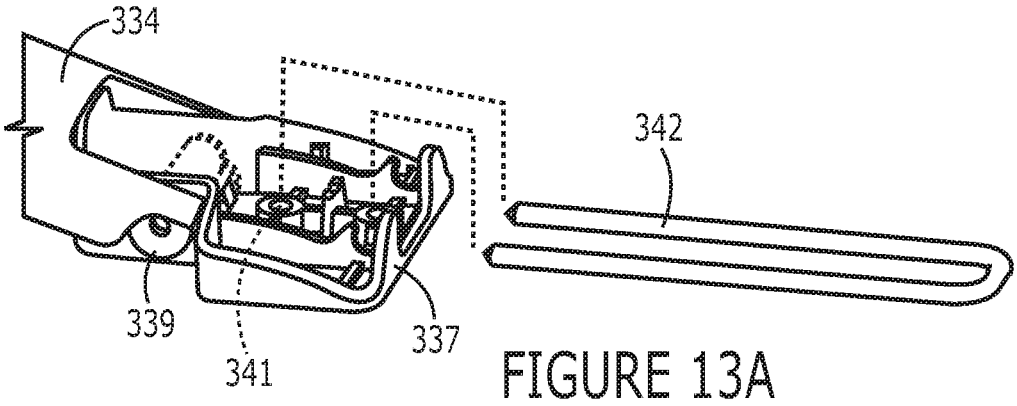
FIGS. 13A and 13B are close-up, perspective views of portions of a base of the lighting system as in FIG. 12.
Figure 13B:
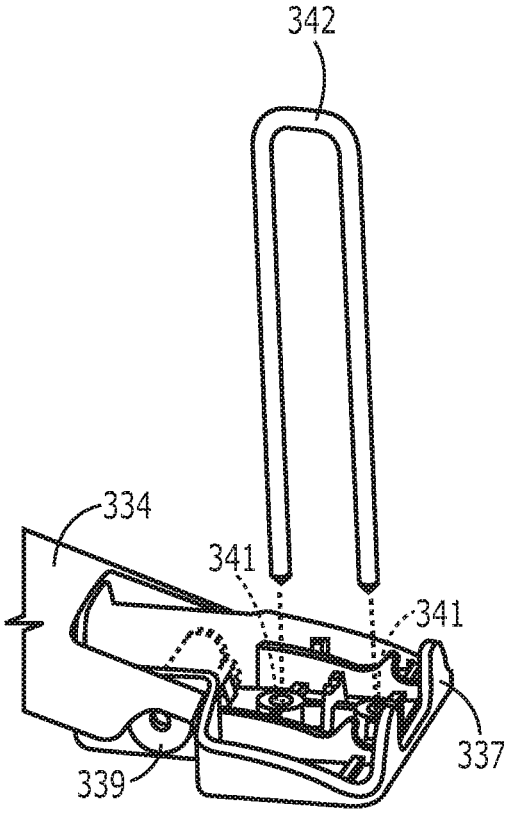

As shown most clearly in FIGS. 13A and 13B, the exemplary extension 334 introduced in FIGS. 10 and 11 may be articulated by an articulating joint 339 to extend downward and approximately parallel to ground. The anchor 342 can be stored within the extension 334 substantially parallel to along a major axis of the extension 334 and then removed to fit over the extension 334 to anchor it to ground. More particularly, the capture gate 337 may include one or more receptacles or apertures 341 through which the anchor 342 may project into ground as shown in FIG. 13B.

Figure 14:
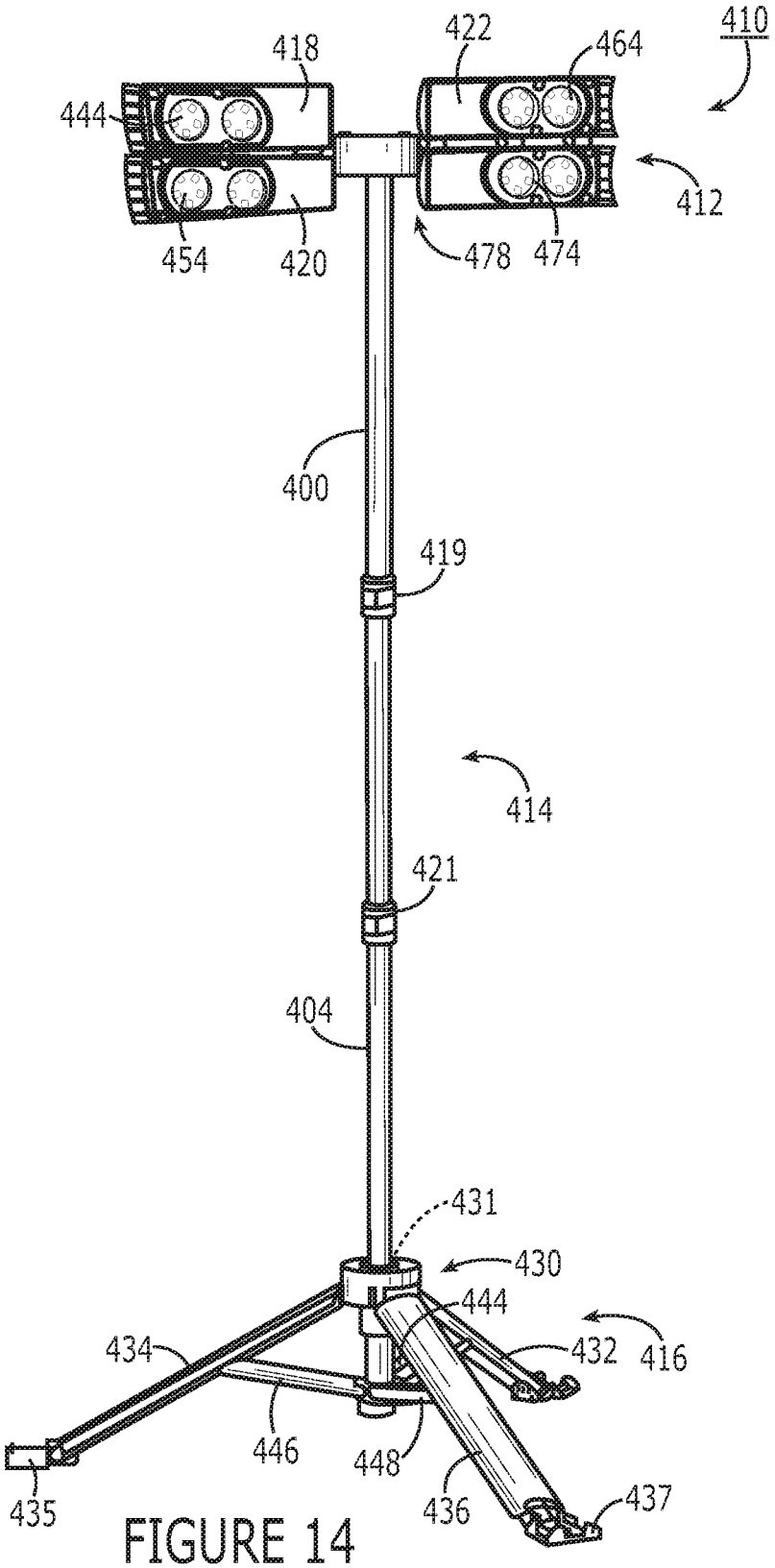
FIG. 14 is a front elevational view of a lighting system according to another aspect of the present disclosure, particularly showing the system in a first condition.
Figure 15:
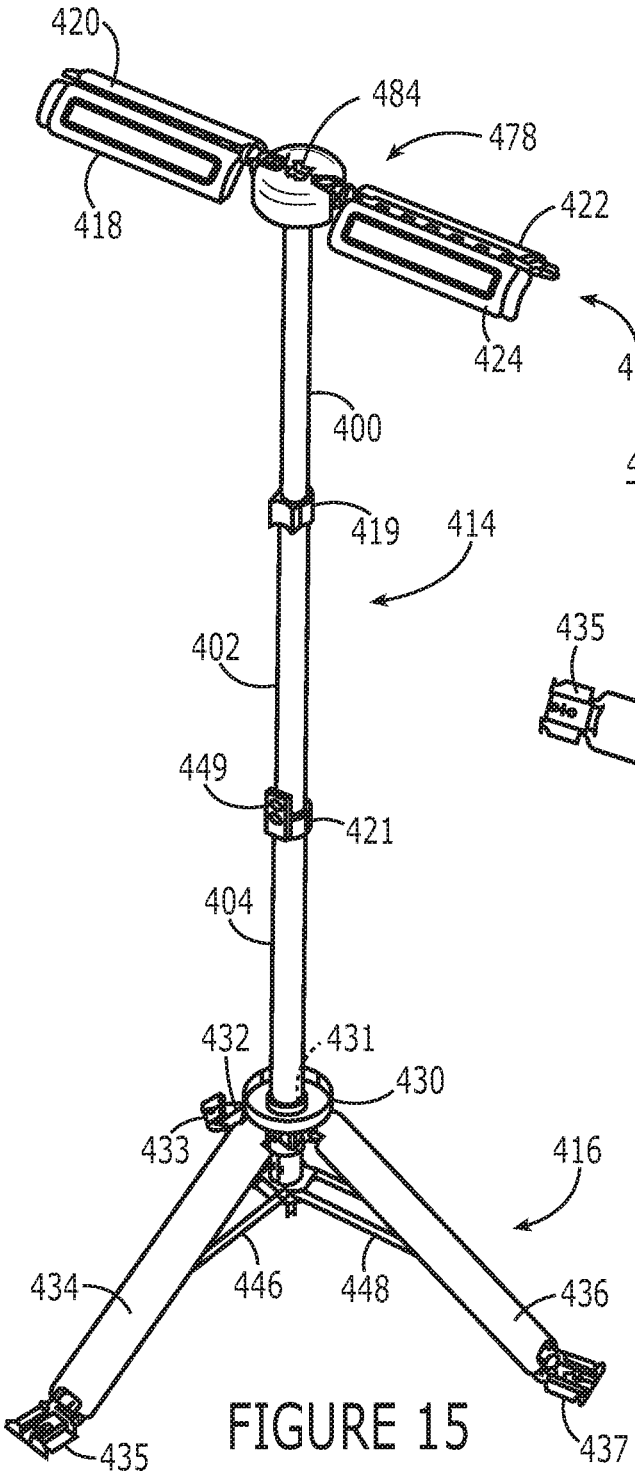
FIG. 15 is a perspective view of the lighting system as in FIG. 14, particularly showing the system in another operational condition.
Figure 16:
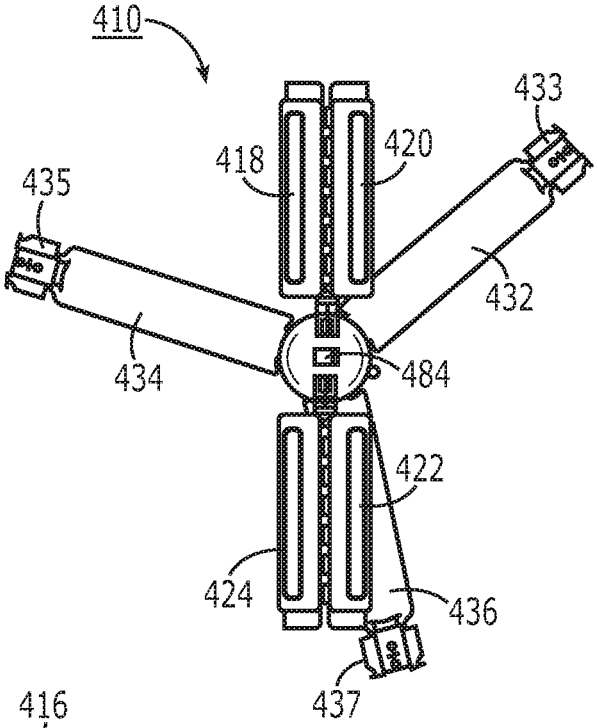
FIG. 16 is a top plan view of the lighting system as in FIG. 15.

Turning now to FIGS. 14, 15 and 16, a tripod lighting system, designated in general by reference number 410, is shown in a first condition or state such as an open or extended position. The exemplary lighting system 410 broadly includes a top, top apparatus, or head 412, a middle portion or body 414, and a base or stand 416. As shown, the head 412 will have a light arm, panel or wing 418 and may have additional, multiple panels such as panels 420, 422, 424. The panels 418, 420, 422, 424 each may have one or more lights or light emitting diodes (LEDs) designated, respectively, 444, 454, 464, 474. The panels 418, 420, 422, 424 may be operably connected or attached to the head 412 at a top or end cap assembly 478. The body 414 may include multiple extension components, rods, or bars 400, 402, 404. Here, a slidable collar or ring 430 is disposed about the rod 404 and a release lock mechanism 421 is located between the rod 402 and rod 404. Similarly, a release lock mechanism 419 is located between rods 400 and 402.

FIGS. 15 and 16 most clearly show a release mechanism, tab or locking button 484. The button 484 may be depressed or activated to release the light panels 418, 420, 422, 424 and open the assembly 410. As shown, the base 416 may include multiple feet, legs or extensions such as legs 432, 434, and 436. Each of the legs 432, 434, 436 may have respective extension features or capture feet 433, 435, 437 that flip open or fold outward to reveal respective apertures 441. Pins or stakes 442 (see FIG. 17B) may be stored in the assembly 410 to be removed and inserted into the apertures 441 to buttress, trap, or press against the capture feet 433, 435, 437 to anchor the system 410 to earth.

Although three legs 432, 434, and 436 are shown by way of a tripod example in FIGS. 14, 15 and 16, the legs can have different sizes and may vary in number. Here, the legs 432, 434, and 436 are curved or tapered and operably connected or attached to the collar 430. Each leg has a respective rod or bar 444, 446, 448, which bend, slide or articulate to extend or contract with movements or adjustments of the collar 430. More particularly, the collar 430 includes a hole or aperture 431, which is sized to slide up and down the rod 404. As particularly shown in FIG. 15, the collar 430 has a cup or bowl-shaped form or basin to receive portions of the light panels 418, 420, 422, 424 in a closed state, as discussed in more detail with respect to FIG. 17A, 17B below. As the collar 430 moves downward or in a direction away from the head 412, the legs 432, 434, 436 extend outward as shown. In this fully extended state, the exemplary lighting system 410 may stand approximately 72 inches to about 80 inches in height, particularly about 76 inches.

Figure 17A:
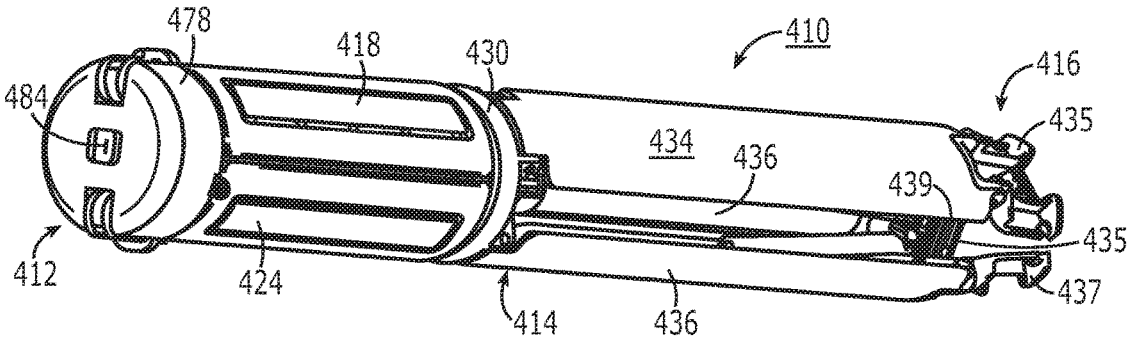
FIG. 17A is a perspective view of the lighting system as in FIG. 14, particularly showing the system in a portable state.

In the second or closed state shown FIG. 17A, an exterior or outer shell of the first light panel 418 and an exterior or outer surface of the fourth light panel 424 of the lighting system 410 are shown next to each other substantially between the head 412 and the body 414. The exterior surfaces and other exterior shells may be made of durable, water-resistant, scratch-resistant material such as moldable thermoplastic, including but not limited to an acrylic-polyvinyl chloride composite or polyethylene (high (HDPE) or low density (LDPE)).

FIG. 17A most clearly shows the button or light panel locking device 484, briefly introduced above with respect to FIG. 15. Here, the button 484, which is normally flush with a surface of the end cap 478, may be depressed or activated to lock and unlock the light panels 418, 420, 422, 424. Alternatively, the lighting panel locking device 484 may be a dial, tab, or slidable locking device that can be slid to one side to unlock the lighting panels 418, 420, 422, 424, and then the slidable locking device 484 can be slid in an opposite direction to lock the lighting panels 418, 420, 422, 424. In one aspect, only one hand is needed to unlock, hold and rotate the light panels 418, 420, 422, 424. This is particularly helpful in a situation where only one hand is available. For instance, when in unlocked position activated by one press or slide of the button 484, any of the light panels 418, 420, 422, 424 can be geared up and down freely. By pressing or sliding the button 484 twice to activate a locked position, the light panels 418, 420, 422, 424 can only be geared up to prevent them from falling downwards when repositioning the light assembly 410. In other words, the light assembly 410 can be moved with the light panels 418, 420, 422, 424 in extended positions rather than having to fold them closed and readjusting them if the light assembly 410 has to be moved. Although one depression is used in this example to unlock and two depressions activate a locked position, the embodiment is not limited to those selections. For instance, one depression could be used to lock and two depressions to unlock the system 410.

As briefly introduced above, FIG. 17A also shows that terminal or distal ends or eaves of the light panels 418, 420, 422, 424 (compare eaves 41, 51, 61, 71 in FIG. 4) are tucked into the basin-like collar 430 in the closed state. As shown, the combination of the curved light panels 418, 420, 422, 424, their stored eaves and the circular collar 430 opiate to form a flush, compact, cylindrical assembly 410 in its closed state.

Figure 17B:
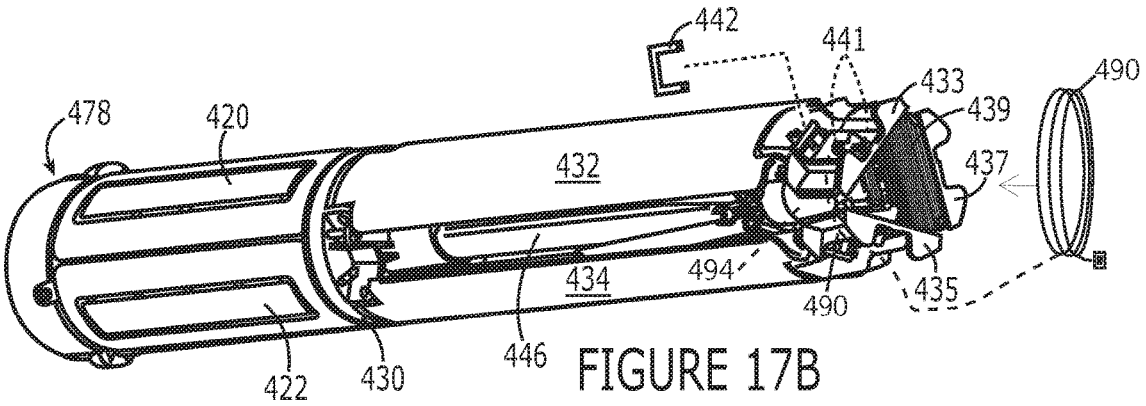
FIG. 17B is another perspective view of the lighting system as in FIG. 17A.

FIG. 17B particularly shows the light panels 420, 422 in the closed state. As with their counterpart panels 418, 424, the exemplary curvatures of the light panels 420, 422 allow them to be folded flush, or in line with, or under a periphery of, the end portion 478 located near the crown 412. Also shown extending from the collar 430 in FIGS. 17A,B is the outer surface leg 434 and complementary structural shaft or rod 446 positioned next to leg 432 and its related shaft. Shown most clearly in FIG. 17B is a grip or non-slip surface 439, which, when the feet 433, 435, 437, are extended, help the system 410 to remain stationary on a smooth surface, such as ceramic tile or polished wood. Also in this embodiment, a power cord or cable 490 (shown partially in phantom) can be wrapped around an indented space or power cable holder 494 created when the feet 433, 435, 437 are closed together.

Figure 18:
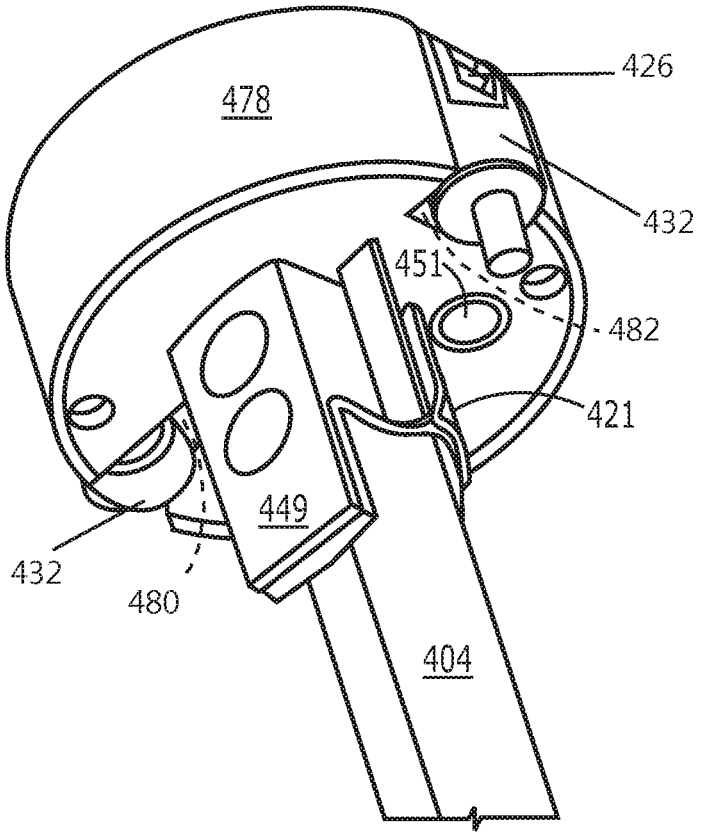
FIG. 18 is partial, perspective view of a portion of the lighting system as in FIGS. 17A and 17B.

FIG. 18 shows a portion of the lighting system 410 partially assembled (i.e., without the light panels 418, 420, 422, 424 of FIG. 17A) to most clearly show the end cap assembly 478 and joints 432 that may rotate about respective arms 426 in respective sockets 480, 482. Also shown is a remote power sensor assembly 449 located on one of the locking collars 421 slidably attached about the pole 404 near the cap 478 in a folded or collapsed position. Comparatively, when the light assembly 410 is fully extended, or in an open state as in FIG. 15, the sensor 449 will be positioned approximately in a middle of the assembly 410.

FIG. 18 also shows an onboard, back-up power switch 451 installed at or near the end cap 478. In the event that a remote unit is lost or non-functioning or simply for convenience, the power switch 451 may be used manually to turn the light assembly 410 on or off, or to activate one or more of the light panels 418, 420, 422, 424 shown in FIG. 17A and/or to adjust brightness levels of all or individual light panels 418, 420, 422, 424.

Figure 19:
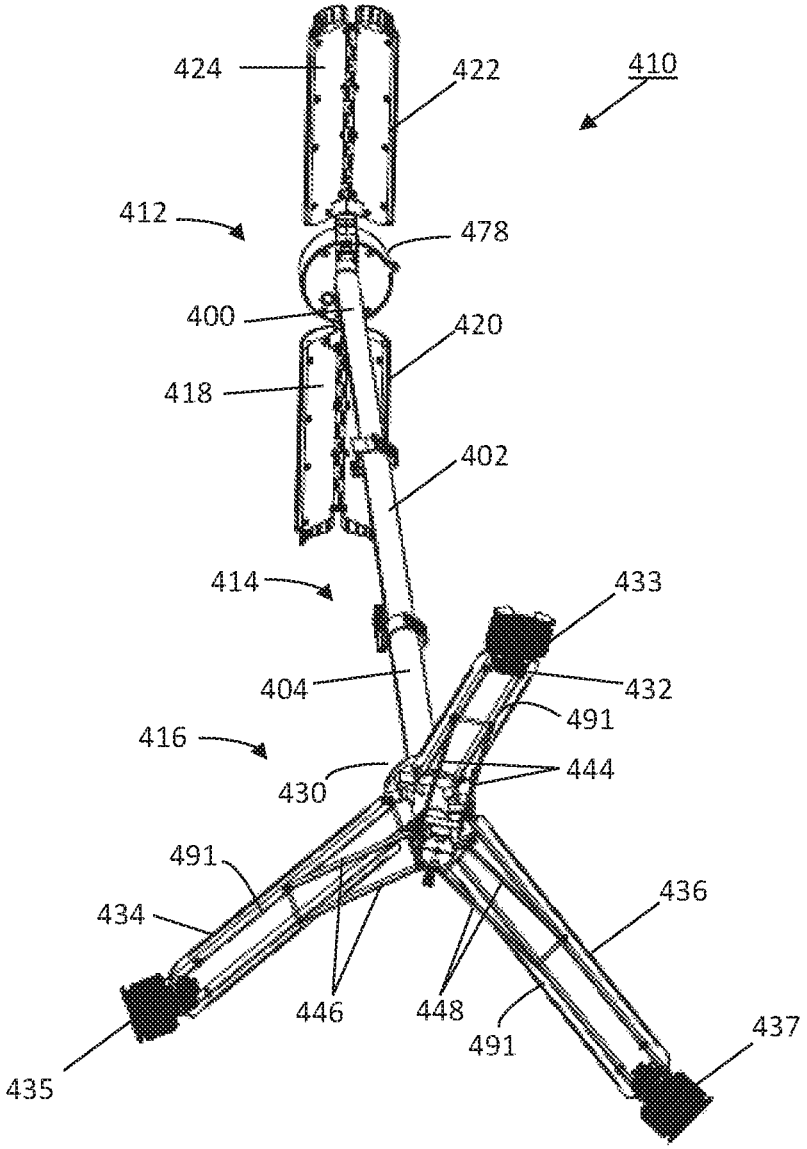
FIG. 19 is bottom perspective view of the lighting system as in FIG. 15.

The tripod lighting system 410 is further shown in FIG. 19 from an underside in an open state. As shown, similar to FIG. 15, the crown portion 412, the body 414, and the base section 416 stand in clear relation to each other in FIG. 19. Here, the light panels 418, 420, 422, 424 extend from the cap assembly 478, and the extension tubes 400, 402, 404 form the body 414. FIG. 19 also most clearly shows a manner in which the bars 444, 446, 448 are slidably connected to respective legs 432, 434, 436. In this example, the bars 444, 446, 448 are dual arms that slide along tracks 491 formed in each of the legs 432, 434, 436 according to a position of the collar 430 along the tube 404 as described above. Also as introduced above, the feet 433, 435, 437 shown here extend from their respective legs 432, 434, 436 to stabilize the device 410 on various surfaces, particularly uneven or smooth surfaces.

EXEMPLARY EMBODIMENTS

Embodiment 1

A lighting system comprising a lighting apparatus being configured to exist in at least two states, the lighting apparatus including a head, a body, and a base in adjustable relationship with each other; wherein the lighting apparatus, in a first state, is expanded such that the body is disposed between the head and the base, the head being disposed apart from the base, and wherein, the lighting apparatus, in a second state, is tubular in shape, the body being collapsed such that the head and the base are proximate each other and closed about respective portions of the body.

Embodiment 2

The lighting system of embodiment 1, wherein the head includes a cap having a plurality of light panels depending therefrom, each of the light panels being movable in at least two axes relative to the cap.

Embodiment 3

The lighting system of embodiments 1 or 2, wherein each of the light panels has a cover disposed on a first side and a light element disposed on an opposing second side.

Embodiment 4

The lighting system of embodiments 1-3, wherein at least one of the light panels is rotatably attached to the cap at a first juncture and at least another of the light panels is rotatably attached to the cap at a second juncture apart from the first juncture, the light panel at the first juncture being movable in at least two axes relative to the light panel at the second juncture.

Embodiment 5

The lighting system of embodiments 1-4, wherein the cap includes a gap configured to receive a portion of the light panels in the second state.

Embodiment 6

The lighting system of any of the foregoing embodiments, wherein the body includes a first rod and a second rod, the first rod being smaller than the second rod such that a portion of the first rod is slidable into the second rod to cause the second state.

Embodiment 7

A lighting system comprising a light head having a plurality of light panels, the panels being adjustable relative to each other; a body having at least two rods, the rods being configured to telescope relative to each other; a base having a plurality of feet; and a quick release mechanism for adjusting the body.

Embodiment 8

The lighting system of embodiment 7, wherein each light panel is configured to adjust in at least three axes.

Embodiment 9

The lighting system of embodiments 7-8, wherein the quick release mechanism includes a ring and a handle, the handle being configured to apply pressure to the ring to render the rods stationary.

Embodiment 10

The lighting system of embodiments 7-9, further comprising a collar configured to move about one of the rods and to adjust the feet.

Embodiment 11

The lighting system of embodiments 7-10, wherein the body further comprises a stand having a space defined therein, and further comprising an anchor disposed in the space, the anchor being configured to extend from the body to stabilize the system.

Embodiment 12

A method of employing a lighting system, comprising providing a lighting assembly having a plurality of light panels and a stand assembly, the light panels being adjustable relative to each other in at least two axes; opening the lighting assembly to expose the light panels; extending the stand assembly; and adjusting the panels for illumination.

Embodiment 13

The method of embodiment 12, wherein the light panels are adjustable in at least three axes.

Embodiment 14

The method of embodiments 12-13, further comprising stabilizing the lighting assembly with an anchor disposed in the lighting assembly by extending the anchor to ground.

Embodiment 15

The method as in embodiments 12-14, further comprising a cap on the lighting assembly, the light panels being movably connected to the cap and adjustable relative to the cap and to each other.

Embodiment 15

The method as in embodiments 12-154, further comprising a power supply carried in the lighting assembly, the power supply in communication with the light panels.

While the present subject matter has been described in detail with respect to specific embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art. Furthermore, the foregoing description of various embodiments does not necessarily imply exclusion. For example, "some" embodiments may include all or part of "other" and "further" embodiments within the scope of this invention. In addition, "a" does not mean "one and only one"; "a" can mean "one and more than one." Furthermore "first", "second" and like terminology may be used herein as differentiating descriptors and may not mean primary, secondary and the like, nor do such terms dictate temporal limitations, unless expressly stated in context.

That which is claimed is:

1. A lighting system, comprising:

a lighting apparatus being configured to exist in at least two states, the lighting apparatus including a head, a body, and a base in adjustable relationship with each other; wherein the lighting apparatus, in a first state, is expanded such that the body is disposed between the head and the base, the head being disposed apart from the base and including a cap having at least two light panels rotatably attached from a first juncture of the cap, each of the two light panels being rotatable relative to each other and being movable in at least two axes relative to the cap, and wherein, the lighting apparatus, in a second state, is tubular in shape, the body being collapsed such that the head and the base are proximate each other and closed about respective portions of the body.

2. The lighting system as in claim 1, wherein each of the light panels has a cover disposed on a first side and a light element disposed on an opposing second side.

3. The lighting system as in claim 1, further comprising a third light panel rotatably attached to the cap at a second juncture apart from the first juncture, the two light panels at the first juncture being movable in at least two axes relative to the third light panel at the second juncture.

4. The lighting system as in claim 1, wherein the cap includes a gap configured to receive a portion of the light panels in the second state.

5. The lighting system as in claim 1, wherein the body includes a first rod and a second rod, the first rod being smaller than the second rod such that a portion of the first rod is slidable into the second rod to cause the second state.

6. A lighting system, comprising:

a lighting apparatus being configured to exist in at least two states, the lighting apparatus including a head, a body, and a base in adjustable relationship with each other; wherein the lighting apparatus, in a first state, is expanded such that the body is disposed between the head and the base, the head including a cap having a first pair of light panels depending from a first juncture of the cap and a second pair of light panels depending from a second juncture of the cap, the light panels of each pair being rotatable relative to each other and being movable in at least two axes relative to the cap, and wherein, the lighting apparatus, in a second state, is tubular in shape, the body being collapsible such that the head and the base are proximate each other and closed about respective portions of the body.

* * * * *